US005193271A

United States Patent [19]

Kato

[11] Patent Number: 5,193,271

[45] Date of Patent: Mar. 16, 1993

[54] MANUFACTURING PROCESS FOR PRESSURE CONNECTING TERMINAL

[75] Inventor: Tetsuo Kato, Shizuoka, Japan

[73] Assignee: Yazaki Corporation, Japan

[21] Appl. No.: 904,012

[22] Filed: Jun. 25, 1992

[30] Foreign Application Priority Data

Jun. 27, 1991 [JP] Japan ..... 3-156938

[51] Int. Cl.[5] ..... H01R 43/00

[52] U.S. Cl. ..... 29/885; 439/886

[58] Field of Search ..... 29/885; 439/395, 397, 439/398, 406, 440, 439, 443, 886

[56] References Cited

U.S. PATENT DOCUMENTS 4,973,262 11/1990 Gerke et al. ..... 439/395

FOREIGN PATENT DOCUMENTS 62-123628 6/1987 Japan .

2-137756 11/1990 Japan .

2-150763 12/1990 Japan .

*Primary Examiner*—P. W. Echols

*Attorney, Agent, or Firm*—Wigman & Cohen

[57] ABSTRACT

A manufacturing process for a pressure connecting terminal which includes an electrical wire connection portion having a slot for pressuring and electrically connecting an electrical wire therewith is disclosed. The pressure connecting terminal is manufactured by punching a blank out of a flat metal base plate in accordance with a predetermined pattern and folding said blank into a predetermined shape. Further, said manufacturing process comprises the steps of: punching said flat base plate so as to create at least said slot; plating at least said slot which is created in said punching step; and folding said blank into said predetermined shape after said plating step.

10 Claims, 7 Drawing Sheets

MANUFACTURING PROCESS FOR PRESSURE CONNECTING TERMINAL

BACKGROUND OF THE INVENTION

The present invention relates to a manufacturing process for a pressure connecting terminal.

By folding a plate member so as to form a frame portion and forming a slot in that frame, a kind of pressure connecting terminal is created. This kind of pressure connecting terminal has been employed for several kinds of wiring. In this kind of pressure connecting terminal, a wire coated with insulation material is pressed downwards into the slot in a way that the insulating coat of the wire is partly cut and stripped. Accordingly, the stripped portion of the coated wire is electrically connected with the pressure connecting terminal.

The above-described type of pressure connecting terminal is shown as an example in FIGS. 1, and 2. This pressure connecting terminal has an extending connection part 3 on one side end of a base plate 1 and an electrical wire connection part 5 on the other side end of the base plate 1. The electrical wire connection part 5 has a box like shape. In the electrical wire connection part 5, pressure connecting parts 11, 13, which are two walls oppositely arranged in a longitudinal direction of the pressure connecting terminal, are provided with slots 7, 9, respectively. A coated wire is placed on the slots 7, 9, pressed downwards, and fitted in the slots 7, 9 so that the insulating coat of the wire is cut and stripped, thereby creating an electrical connection of the stripped wire with the pressure connecting parts 11, 13.

A piece of strip mill comprising a copper alloy is generally employed as a base material for the above-described type of pressure connecting terminal. Further, the piece of strip mill is plated with tin (Sn) in order to improve electrical connectability thereof. Namely, the piece of strip mill is tin plated in order to provide a reliable electrical connection between the electrical wire connection part 5 and a stripped portion of a wire coated with insulation material.

The following is an example of a manufacturing process for the above-mentioned type of pressure connecting terminal. First, a whole piece of strip mill is tin plated in advance. This piece of tin plated strip mill is then sliced so as to provide bars of strip mill each of whose width corresponds to a longitudinal width of the pressure connecting terminal itself. Flat blanks are then punch cut from the bars by means of press working in accordance with a predetermined pattern. Finally, after being folded into a predetermined shape of the pressure connecting terminal, the blank is tin plated a second time in order to form a layer of tin plating on punch cut edges which are newly created after press working, especially, on the edges of slots 7, 9.

In the second example for manufacturing the pressure connecting terminal, a piece of strip mill is sliced so as to provide bars of strip mill each of whose width corresponds to a width of the pressure connecting terminal itself. Blanks are cut from the bars by means of press working. Then, the blank is folded into a predetermined shape of the pressure connecting terminal. Finally, the whole body of the folded pressure connecting terminal is tin plated. Namely, in this example, the tin plating is executed only as a final step.

Inconveniently, the first example described above requires that tin plating be carried out twice, thereby resulting in a high manufacturing cost. Moreover, because the tin plating takes place twice, an unnecessary thickness of the tin layer on the pressure connecting terminal develops. In this way, when recycled, an inconvenient removing process for the thick tin layers may be required.

With regard to the latter example, the fact that tin plating occurs only one time may be convenient. However, since the tin plating is applied to the pressure connecting terminal which was previously formed into a particular shape, surface irregularities with respect to the tin plating may occur often, and, in a most unfortunate situation, tin plating of the slots 7, 9 does not succeed.

SUMMARY OF THE INVENTION

In view of the above, an object of the present invention is to solve the aforementioned problems in the prior art through the introduction of a manufacturing process for a pressure connecting terminal, wherein a slot or the like in a pressure connecting terminal is plated in a uniform manner by one plating step so that reliability of achieving an electrical connection may be significantly improved.

The aforesaid object of the present invention is accomplished through a manufacturing process for a pressure connecting terminal which includes an electrical wire connection portion having a slot for pressuring and electrically connecting an electrical wire therewith and which is manufactured by punching a blank out of a flat metal base plate in accordance with a predetermined pattern and folding said blank into a predetermined shape, said manufacturing process comprising the steps of: punching said flat base plate so as to create at least said slot; plating at least said slot which is created in said punching step; and folding said blank into said predetermined shape after said plating step.

In the above-described manufacturing process for a pressure connecting terminal according to the present invention, since said slot is plated after being created in said base plate, the slot of a pressure connecting terminal is plated in a uniform manner by one plating step so that a reliability of achieving an electrical connection is significantly improved.

DETAILED DESCRIPTION OF THE PREFERRED EMBODIMENTS

An embodiment according to the present invention will be described hereinafter using FIGS. 3~10C.

Figure 1:
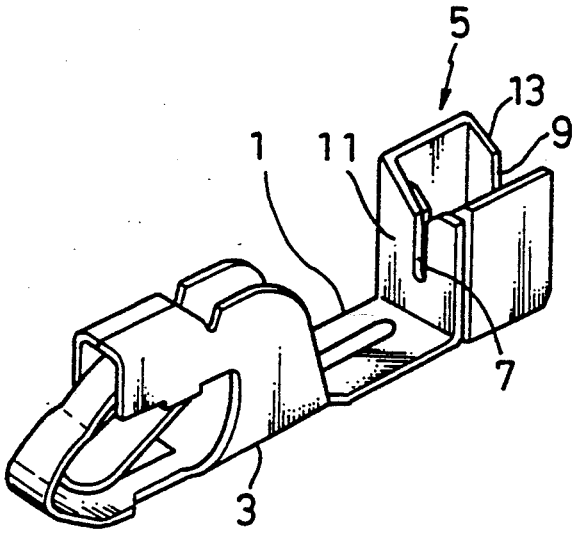
FIG.1 PRIOR ART
FIG. 1 is a perspective view of a pressure connecting terminal according to a conventional example.
Figure 2:
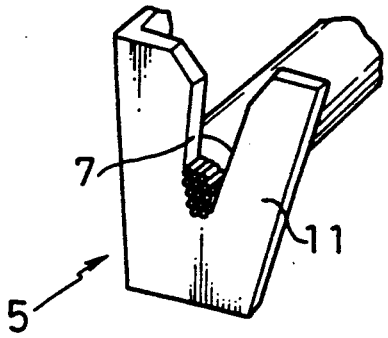
FIG.2 PRIOR ART
FIG. 2 is a fragmentary enlarged perspective view of an electrical wire connection part illustrated in FIG. 1.
Figure 3:
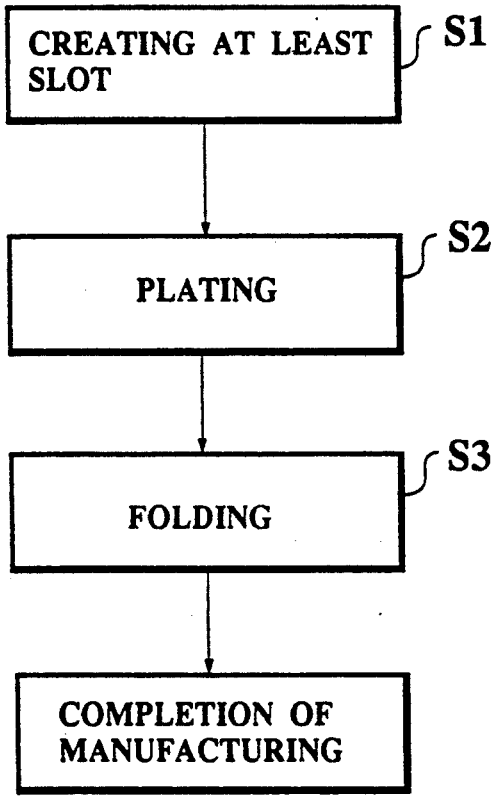
FIG. 3 is a flow chart of a manufacturing process for a pressure connecting terminal according to the present invention.

FIG. 3 illustrates a flow of a manufacturing process for a pressure connecting terminal. The manufacturing process includes a punching step S1, a plating step S2, and a folding step S3.

Figure 4:
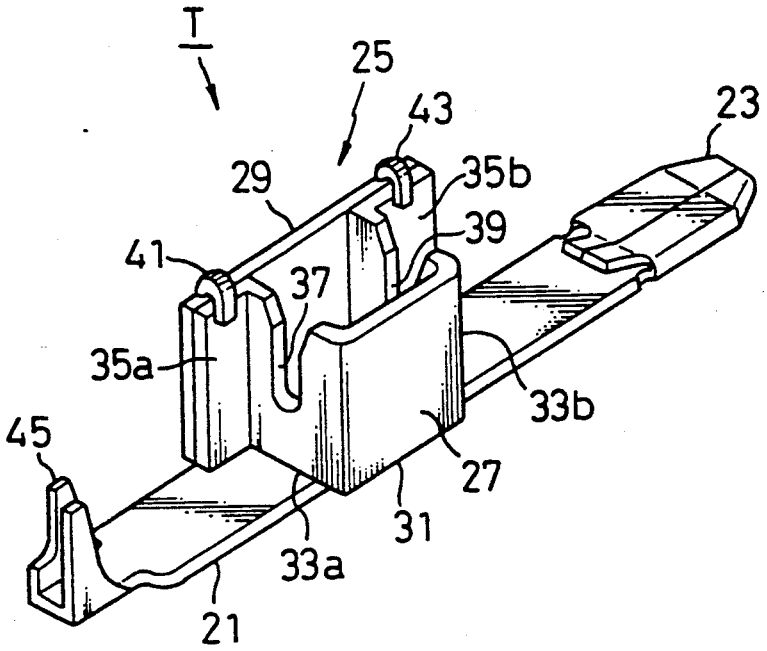
FIG. 4 is a perspective view of a pressure connecting terminal according to the present invention.

FIG. 4 illustrates a perspective view of an entire manufactured pressure connecting terminal T, and FIGS. 5~10C are views for explaining the manufacturing process.

The pressure connecting terminal T, as shown in FIG. 4, comprises a base plate 21, an extending connection part 23 provided on a side end of the base plate 21, and an electrical wire connection part 25 provided approximately on a middle portion of the base plate 21.

The electrical wire connection part 25 has an electrical wire pressure connecting frame part 27 (which will be abbreviated as connecting frame part below) and a reinforcing part 29 and comprises a unitary structure with the base plate 21. The connecting frame part 27 is folded into a certain shape which has a hat-like shape or a channel-like shape when being looked at from the top thereof. (The shape thereof will be referred to as the "hat-channel shape" hereinafter.) Further, the connecting frame part 27 includes: a side wall portion 31 which is folded so as to be erected along a longitudinal direction of the base plate 21; a pair of parallel facing wall portions 33*a*, 33*b* which are folded so as to extend at right angles from side ends of the side wall portion 31; and a pair of reinforcing portions 35*a*, 35*b* which are provided on side ends of the parallel facing wall portions 33*a*, 33*b* and which extend outwards at right angles therefrom. The pair of parallel facing wall portions 33*a*, 33*b* are provided with a pair of slots 37, 39, respectively.

The reinforcing part 29 is folded so as to be erected along the longitudinal direction of the base plate 21, thereby facing parallel to the side wall portion 31 and closing an open end of the hat-channel shaped connecting frame part 27. Further, the reinforcing part 29 is provided with a pair of fixing pieces 41, 43 which, when bent and caulked, combine the reinforcing portions 35*a*, 35*b* with the reinforcing part 29. Metal fittings 45 are provided on one side end of the base plate 21 in order to fix a wire coated with insulated material on the pressure connecting terminal T.

Next, the manufacturing process for the above-described pressure connecting terminal T will be explained below, using FIGS. 5~10C.

In the present embodiment, a base material is exemplified by a piece of strip mill which comprises a copper alloy such as brass. The thickness and width of the strip mill can be, for example, 0.2~0.4 mm and 700~1,000 mm (in the lateral direction thereof).

Figure 5:
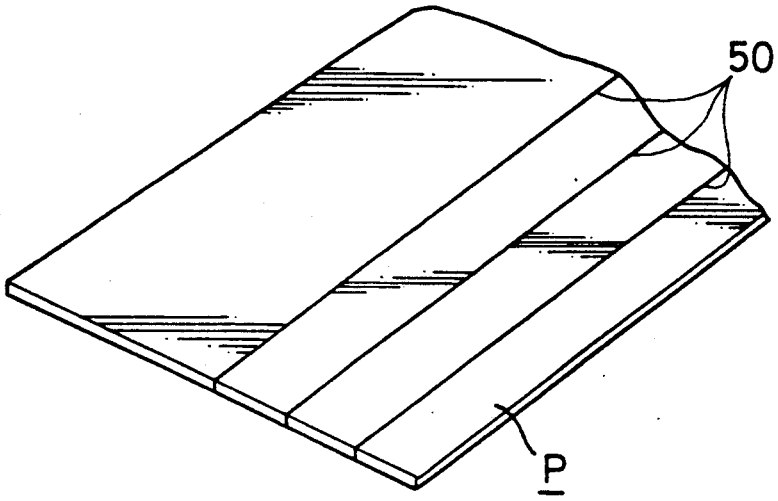
FIG. 5 is a perspective view of a base plate (which corresponds to a piece of strip mill in an embodiment according to the present invention), before entering any manufacturing process, which comprises belt like sheets which are not yet separated from the base plate.

Step one:

In this step, the piece of strip mill is sliced along lines 50 so as to provide belt like sheets P which have predetermined widths as shown in FIG. 5. In the present embodiment, the width of the belt-like sheet P corresponds to a longitudinal width of a metal blanking die to be used in press working, and the width of the metal blanking die may be, for example, 20~40 mm. A longtidinal width of the metal blanking die for press working is determined in accordance with a longitudinal width of the pressure connecting terminal T. Namely, the width of the belt-like sheet P corresponds to the longitudinal width of the pressure connecting terminal T.

Figure 6:
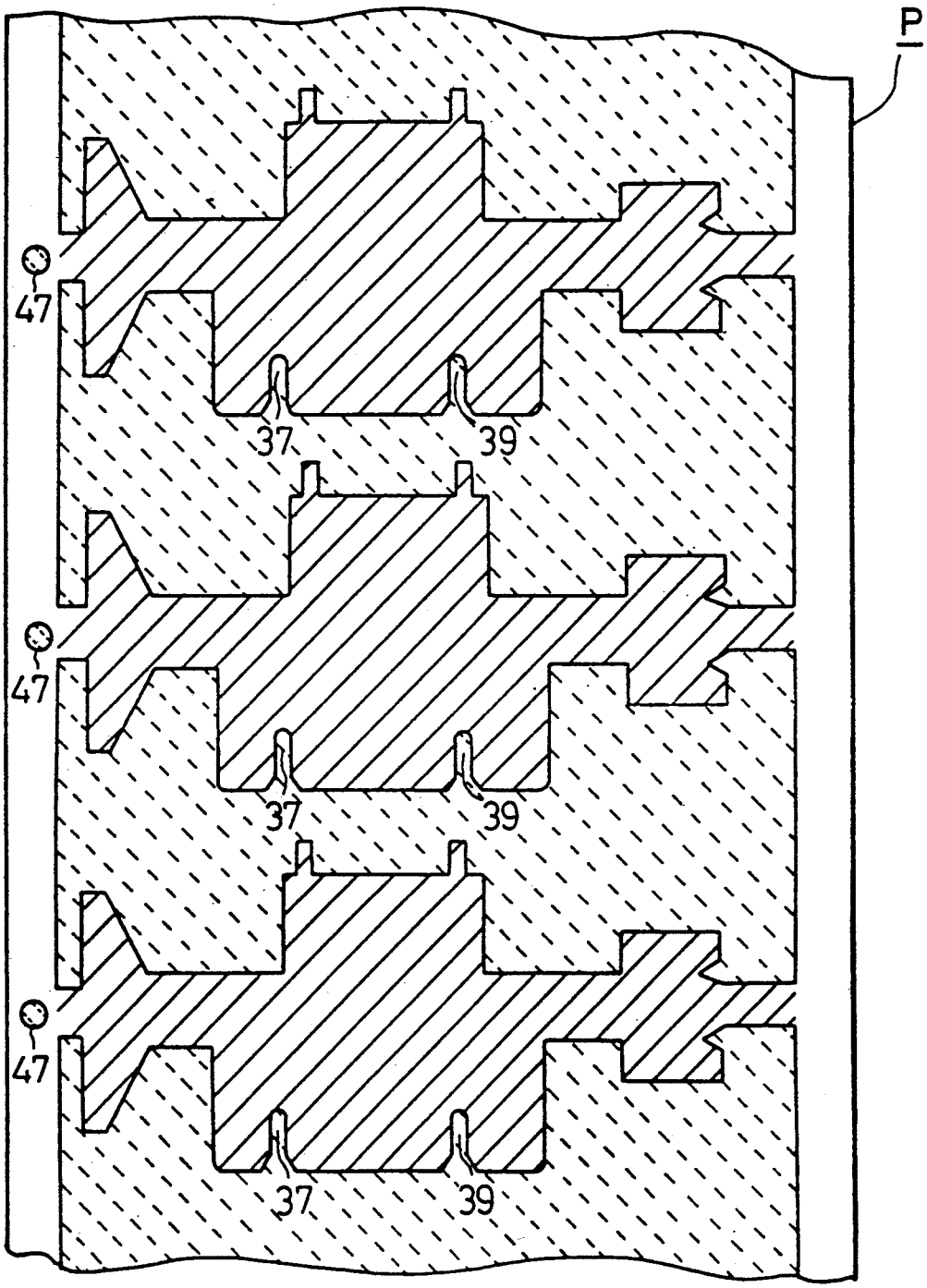
FIG. 6 is an explanatory elevational view of said belt like sheet during a step 2 of an embodiment of the present invention.
Figure 7:
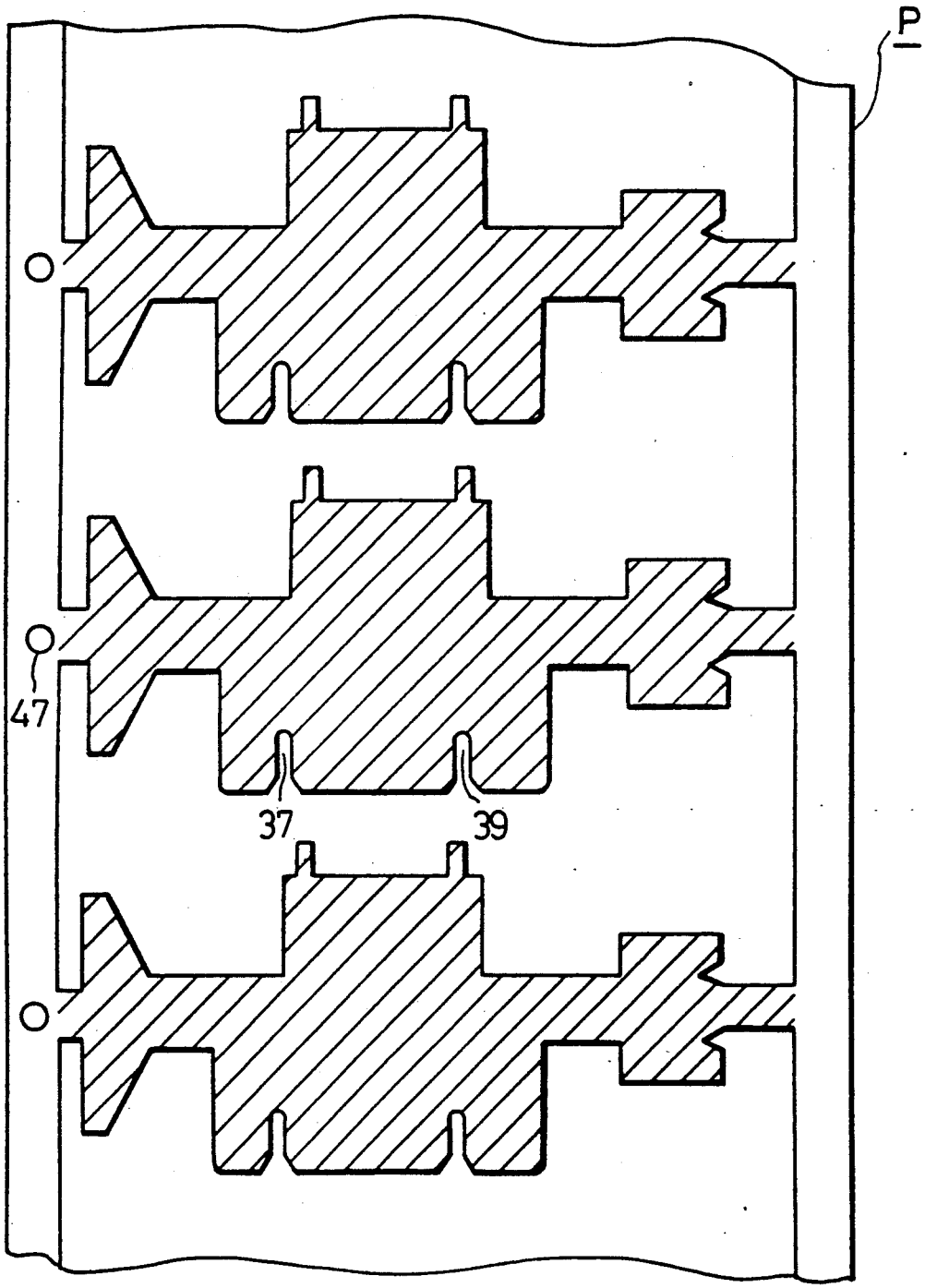
FIG. 7 is an explanatory elevational view of said belt like sheet during a step 3 of an embodiment of the present invention.

Step 2:

This step is explained by FIG. 6 which is an explanatory elevational view of the belt like sheet P. In this step, a first punching step corresponding to the punching step S1 in FIG. 3 is executed by means of press working. Namely, at least slots 37, 39 and positioning holes 47 are punched out in the belt-like sheet P.

Figure 9:
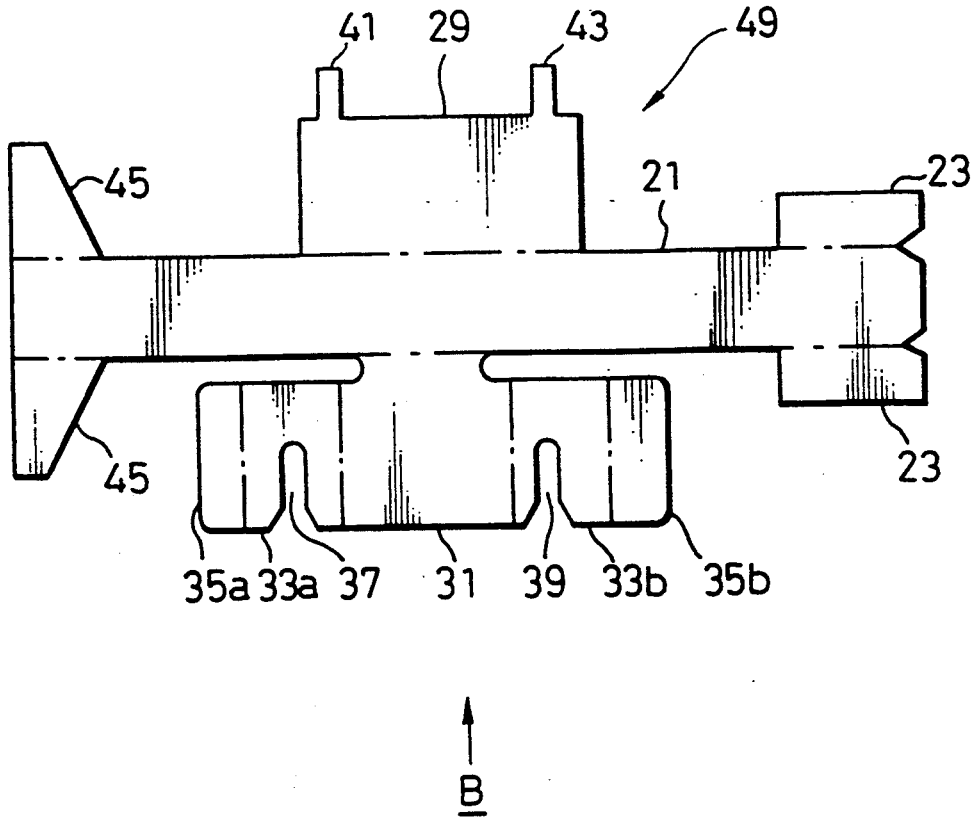
FIG. 9 is an elevational view of said blank during the step 4.

However, it is also possible to punch out an entire blank 49 as shown in FIG. 9 in this step.

Nonetheless, in the present embodiment, portions indicated by slanted dotted lines in FIG. 6 are punched out in the belt-like sheet P in this step, and the remaining portions with respect to the blank 49 which are indicated by slanted solid lines proceed to a folding step described below.

Step 3:

In this step, the plating step S2 in FIG. 3 is executed. Namely, the above-mentioned remaining portions are plated with tin (Sn).

Direct tin plating can be executed, when a hot dipping method is employed. When an electroplating method is used, tin plating can be executed after a rough copper plating.

During this plating step, the tin plating is carried out so as to obtain a predetermined thickness on not only both surfaces of the remaining portions but also edge portions which have been punched and bared during the press working. Namely, this plating step is very advantageous as it forms layers of tin in a uniform manner with respect to the blank 49, especially for slots 37, 39.

Figure 8:
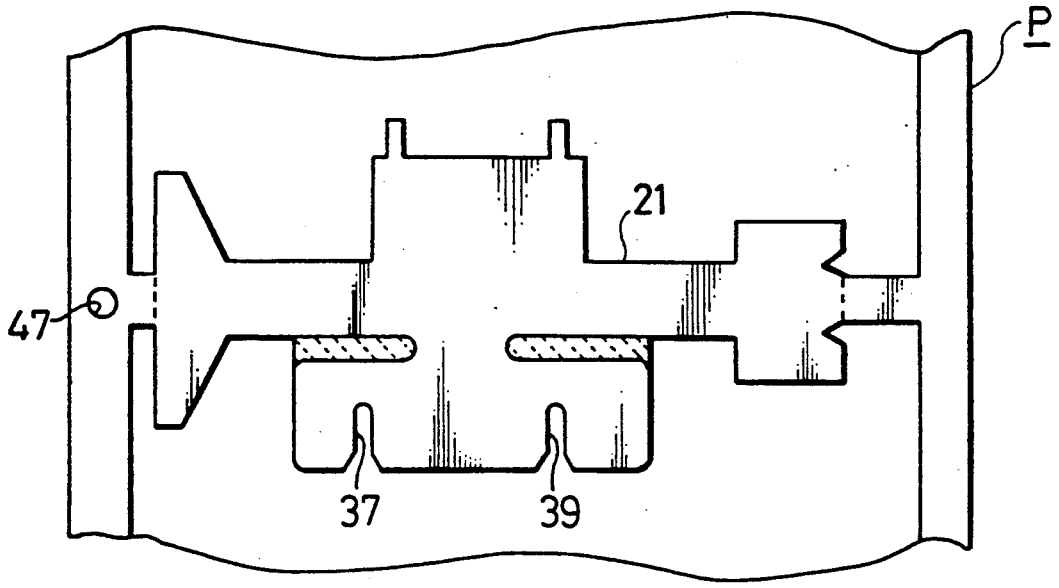
FIG. 8 is a fragmentary, explanatory elevational view of said belt like sheet including a blank during a step 4 of an embodiment of the present invention.

Step 4:

In this step illustrated by FIG. 8, a second punching step is executed by means of press working. Namely, portions represented by slanted dotted lines in FIG. 8 are punched out in the belt-like sheet P, and also side ends of the base plate 21 which are illustrated by dotted lines are cut and separated from the belt-like sheet P.

Consequently, a flat blank 49 as illustrated in FIG. 9 is created. In this blank 49, the reinforcing part 29 and the side wall portion 31 are provided vertically on both sides of the base plate 21, respectively. Further, the side wall portion 31 is provided with the pair of parallel facing wall portions 33*a*, 33*b* on both longitudinal sides thereof and with the pair of reinforcing portions 35*a*, 35*b* each on one side of the pair of parallel facing wall portions 33*a*, 33*b*. The pair of fixing pieces 41, 43 extend from an upper side of the reinforcing part 29. Moreover, the extending connection part 23 is provided on one longitudinal side of the base plate 21, and the metal fittings 45 are provided on the other longitudinal side of the base plate 21.

Figure 10A:
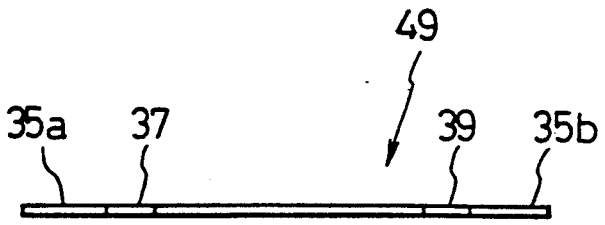
FIG. 10A is a view of the blank taken in a direction shown by an arrow B of FIG. 9.
Figure 10B:
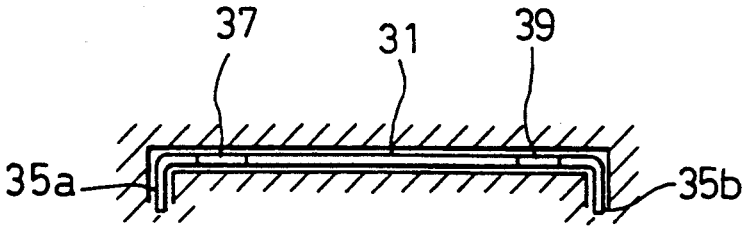
FIG. 10B is an explanatory view of the blank showing a folding step during a step 5 of an embodiment of the present invention and FIG. 10C is an explanatory view of the blank showing a folding step executed after the folding step illustrated in FIG. 10B.
Figure 10C:
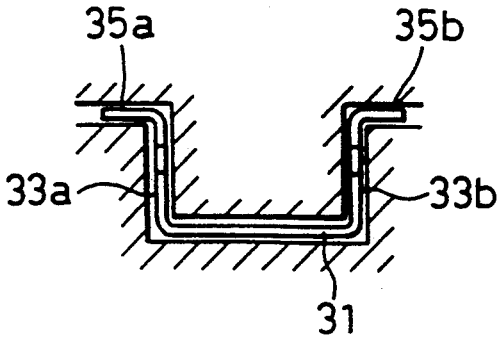

Step 5:

FIGS. 10A~10C explain the folding step S3 in FIG. 3. During this step, the above-described blank 49 is folded into the predetermined shape.

FIGS. 10A~10C follow the order of the folding step. FIG. 10A is a view of the blank 49 taken in a direction shown by an arrow B of FIG. 9. First, the pair of reinforcing portions 35*a*, 35*b* are folded downwards at a right angle to the side wall portion 31 as shown in FIG. 10B. The pair of parallel facing wall portions 33*a*, 33*b* are then folded upwards at a right angle to the side wall portion 31 as shown in FIG. 10C, thereby creating the hatchannel shaped connecting frame part 27 as shown in FIG. 4. Moreover, this connecting frame part 27 and also the reinforcing part 29 are folded and erected at right angles to the base plate 21, respectively. The pair of fixing pieces 41, 43 are then bent and caulked so as to combine the frame part 27 and the reinforcing part 29, thereby forming the electrical wire connection part 25. For the completion of the whole manufacturing process, the extending connection part 23 and the metal fittings 45 are folded so as to form the pressure connecting terminal T as shown in FIG. 4.

By using the above-described manufacturing process, the slots 37, 39 may be tin plated in a uniform manner after only one tin plating step therefor. In addition, since the blank 49 undergoes tin plating prior to being folded so as to form the pressure connecting terminal T, surface irregularity can be controlled. Furthermore, an unnecessary thickness of tin layers may also be controlled, thereby facilitating a recycling process of the pressure connecting terminal T.

What is claimed is:

1. A manufacturing process for a pressure connecting terminal which includes an electrical wire connection portion having a slot for pressuring and electrically connecting an electrical wire therewith and which is manufactured by punching a blank out of a flat metal base plate in accordance with a predetermined pattern and folding said blank into a predetermined shape, said manufacturing process comprising the steps of:
   - punching said flat base plate so as to create at least said slot;
   - plating at least said slot which is created in said punching step; and
   - folding said blank into said predetermined shape after said plating step.

2. A manufacturing process for a pressure connecting terminal as set forth in claim 1,
   - wherein said flat metal base plate is a piece of strip mill consisting of a copper alloy.

3. A manufacturing process for a pressure connecting terminal as set forth in claim 2,
   - wherein said plating material is tin.

4. A manufacturing process for a pressure connecting terminal as set forth in claim 1,
   - wherein said plating material is tin.

5. A manufacturing process for a pressure connecting terminal which includes an electrical wire connection portion having a slot for pressuring and electrically connecting an electrical wire therewith and which is manufactured by punching a blank out of a piece of strip mill in accordance with a predetermined pattern and folding said blank into a predetermined shape, said manufacturing process comprising the steps of:
   - slicing said piece of strip mill into a predetermined width of belt-like sheet in a direction in which said strip mill extends;
   - punching said belt-like sheet so as to create at least said slot;
   - plating at least said slot which is created in said punching step; and
   - folding said blank into said predetermined shape after said plating step.

6. A manufacturing process for a pressure connecting terminal as set forth in claim 5,
   - wherein, said blank is punched by means of press working, and said width of belt-like sheet is predetermined in accordance with a width of a metal blanking die to be used in said press working.

7. A manufacturing process for a pressure connecting terminal as set forth in claim 6,
   - wherein, a width of said piece of strip mill is 700~1000 mm, and said width of the belt like sheet is 20~40 mm.

8. A manufacturing process for a pressure connecting terminal which includes an electrical wire connection portion having a slot for pressuring and electrically connecting an electrical wire therewith and which is manufactured by punching a blank out of a piece of strip mill in accordance with a predetermined pattern and folding said blank into a predetermined shape, said manufacturing process comprising the steps of:
   - slicing said piece of strip mill into a predetermined width of belt-like sheet in a direction in which said strip mill extends;
   - punching said blank including said slot, but excluding a lateral side end part of said blank, out of said belt-like sheet;
   - plating at least said slot which is created in said punching step; and
   - folding said blank into said predetermined shape after said plating step.

9. A manufacturing process for a pressure connecting terminal as set forth in claim 8,
   - wherein, said blank is punched by means of press working, and said width of belt-like sheet is predetermined in accordance with a width of a metal blanking die to be used in said press working.

10. A manufacturing process for a pressure connecting terminal as set forth in claim 9,
   - wherein, a width of said piece of strip mill is 700~1000 mm, and said width of the belt like sheet is 20~40 mm.

* * * * *